US007708144B2

(12) United States Patent
Windgassen et al.

(10) Patent No.: US 7,708,144 B2
(45) Date of Patent: May 4, 2010

(54) PROCESS FOR SEPARATION OF PHOSPHATIC MATERIALS FROM COASTAL BEACH SAND

(76) Inventors: Richard Windgassen, 610 Ironwood Cir., Venice, FL (US) 34292; James R Windgassen, 1613 Bayside Dr., Chester, MD (US) 21619; Russell H Swenson, 201 N. Tyler Rd., #236, St. Charles, IL (US) 60174

( * ) Notice: Subject to any disclaimer, the term of this patent is extended or adjusted under 35 U.S.C. 154(b) by 0 days.

(21) Appl. No.: 11/983,133

(22) Filed: Nov. 7, 2007

(65) Prior Publication Data

US 2009/0114572 A1 May 7, 2009

(51) Int. Cl.
*B03D 1/02* (2006.01)
*B03D 1/008* (2006.01)

(52) U.S. Cl. ..... 209/164; 209/166

(58) Field of Classification Search ..... 209/166, 209/164

See application file for complete search history.

(56) References Cited

U.S. PATENT DOCUMENTS 1,795,100 A * 3/1931 Wilkinson et al. ..... 209/166
1,798,452 A * 3/1931 Butchart ..... 261/93
1,912,433 A * 6/1933 Crago et al. ..... 209/166
1,968,876 A * 8/1934 Crago et al. ..... 252/61
3,097,162 A 7/1963 Baarson
3,098,817 A * 7/1963 Baarson et al. ..... 209/166
3,117,924 A 1/1964 Baarson
3,298,519 A * 1/1967 Hollingsworth ..... 209/165
4,126,275 A * 11/1978 Timberlake et al. ..... 241/1
4,247,391 A * 1/1981 Lloyd ..... 209/164
4,732,667 A 3/1988 Hellsten et al.
4,750,994 A * 6/1988 Schneider ..... 209/170
4,968,415 A 11/1990 Morawietz et al.
5,124,028 A 6/1992 Klimpel
5,295,584 A 3/1994 Krause et al.
5,376,182 A 12/1994 Everett et al.
6,409,022 B1 6/2002 Rothenberg et al.
6,994,786 B2 2/2006 Cameron et al.

OTHER PUBLICATIONS

Tracy A. Monegan, Beach Sediment Analysis of Sarasota County, Florida: Implications for the Origin of Phosphate Miocene Sands.
Al-Fariss, T.F. & Abdulrazik, A.M., Use of Sea Water in the Flotation of Carbonate Rich Sedimentary Phosphate Rock, Fertilizer Research 34, Apr. 15, 1993, pp. 217-222, Kluwer Academic Publishers.

* cited by examiner

*Primary Examiner*—Thomas M Lithgow
(74) *Attorney, Agent, or Firm*—Charles J. Prescott

(57) ABSTRACT

A process for separating phosphatic materials from coastal beach sand and sand deposits used for beach renourishment. The steps include (a) suspending a mixture of beach sand and phosphatic material in water, (b) introducing compressed gas, preferably air, into the mixture or sparging to produce a bubble froth on the surface of the water, and (c) skimming or separating the bubble froth from the surface of or within the water to effect separation of the phosphatic material in the froth from the beach sand left in the water. The bubbles of the bubble froth attract and carry the phosphatic material on the surface of the bubbles during upward movement through the mixture. A conditioner added to the water which improves the tendency of the phosphatic material to "float" is preferred.

20 Claims, 1 Drawing Sheet

PROCESS FOR SEPARATION OF PHOSPHATIC MATERIALS FROM COASTAL BEACH SAND

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

Figure 1:
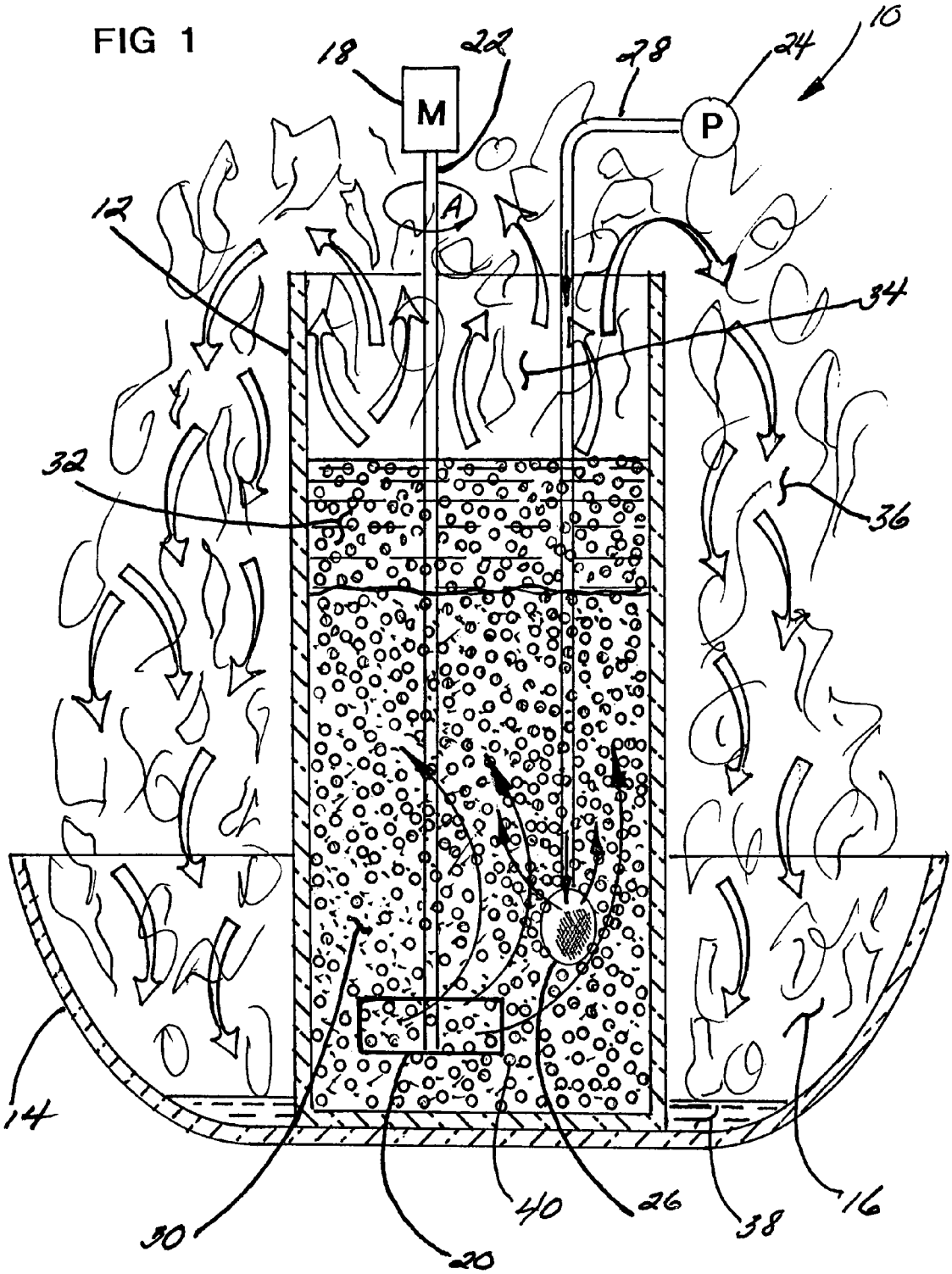

This invention relates generally to the aesthetic and environmental beneficiation of coastal sands. More specifically this invention relates to separation of phosphatic materials from coastal sands in existing beaches, or in marine and near shore sand deposit resources, by flotation processes.

2. Description of Related Art

Attractive beaches are valuable assets to coastal communities. Beaches are accumulations of loose sediment along the shoreline. Some beaches have rocks, but the most valuable beaches have sand particles in the range of about 0.1 mm to 1 mm.

The origin of sand is mineral fragments broken from coastal and inland rocks. Wave action and shifting coastal currents abrades the fragments as beaches, barrier islands, and marine and land deposits are formed and reformed over long periods of geologic time.

Most of the beaches along the southeastern and gulf coasts of the United States are desirable light colored to almost white. The rapid erosion that once brought fresh mineral material to the coasts slowed long ago, and only the exceptionally hard, water resistant, clear white quartz has survived eons of wear as rounded sand grains in the 0.1 mm to 0.2 mm diameter range.

Maintaining high quality beaches can be costly. Once polluted, a beach may take decades for natural forces to restore it. Wave and coastal currents, especially during storms, can seriously erode or even eliminate beaches that foster tourism and protected coastal construction. Beaches can be enlarged or restored through a process referred to as beach nourishment or renourishment, which may require importing hundreds of thousands of cubic yards of sand to the affected site. Locating such large deposits of acceptable quality sand is difficult. Because shifting coastal currents make beaches part of a dynamic process, mining some marine sand deposits may cause other beaches to erode. Poor quality sand used to renourish a beach may eventually be carried to other beaches in coastal currents.

Beaches and coastal sands frequently contain shells and shell fragments, and phosphatic materials. Intact shells are often attractive to beach goers, and small amounts of shell fragments are usually not objectionable. But the phosphatic material found in coastal sands on the west coast of Florida, some California beaches, and likely many beaches worldwide, can be objectionable because of its dark color, and high concentrations of phosphorus and fluorine. It is surprising that the benefits of removing these phosphatic materials from beach sands by processes such as flotation have not been recognized.

Phosphorus is the eighth most abundant element in the earth's crust, and deposits of minerals containing the element are widespread. Phosphorus has very limited solubility in seawater, and the element forms deposits in seawater called phosphorites in association with calcium and fluorine. The phosphorite typically contains about 15% of phosphorus (% P) and 2-3% of fluorine (% F). The phosphorite is brown to black in color because organic matter contaminants are present.

Much of the southern Florida peninsula is underlain by a shallow deposit of thick phosphorite that formed in ancient times. This deposit has been disturbed by natural river flow, as well as human activity. Other phosphorite may arrive on the coast from other land and marine deposits. Animals build the inorganic portion of their bones from the mineral hydroxyapatite, Ca (5) PO (4) (3) OH, and fossilized bone is common both onshore and offshore. Fossilized bone contains about 15% of phosphorus, and strongly absorbs fluorine from the environment until it contains about 1% of fluorine. Fossilized bone is also often dark from organic impurities.

Thus phosphorites and fossil bone have about identical negative effects on coastal sands, and both are included herein in the term "phosphatic material". The presence of small grains of phosphatic material darkens a beach: the presence of larger particles or pebbles of phosphatic material gives the appearance of contamination with charcoal or partially burned items. The phosphatic material contains potentially toxic concentrations of fluorine if ingested. When the phosphorus is solubilized, it can contribute to excessive growth of algae, and to the organisms that cause highly destructive coastal red tides.

Phosphatic materials are dissolved by acid in the stomach, but contain far too much fluorine for use as an animal feed phosphorus supplement. A ½ cm diameter pebble of phosphatic material contains about 7 mg of fluorine. The toxic dose of fluorine varies widely by animal species. The LD50 (the 50 percentile lethal dose for animals) for fluorine is about 32 mg per kg for humans. Adult humans would not be at risk, although a child ingesting an attractive shiny black pebble of phosphatic material could become ill. The LD 50 for dogs is only 4mg per kilogram, but ½ mg per kilogram causes visibly toxic effects. The LD50 for wild birds is estimated at about 50 mg per kilogram, but many birds must consume stones for grit to aid digestion, and such birds might be at risk of cumulative fluorine poisoning from phosphatic material.

The concentration of phosphorus in surface ocean water is very low, on the order of 0.01 mg per liter of water. The low concentration of phosphorus is often the limiting nutrient for growth, and the resulting small number of algae and other small organisms assures water clarity. An increase in the number of upper surface organisms can cause death of bottom life by shading, or by oxygen depletion if the organisms at the surface settle, die and decay. The deterioration of many coastal bays and estuaries has been blamed on increased phosphorus flows from farmlands and lawns, septic tanks and sewage. The increased flow of phosphorus from land sources is also suspected by many to be responsible for the increasing number of red tide incidents as well as their severity and duration.

Red tides occur on all coasts of the United States and many other regions of the world, but in Florida they are very frequent. The organism that causes the red tide reproduces rapidly and produces potent toxins that litter beaches with dead fish. If the wind is blowing toward shore, the toxin in the air causes severe respiratory problems for persons on or near the beach. The factors that cause the rapid growth of the red tide organisms are not well understood. Even if an increased phosphorus concentration is not the direct cause of a red tide incident, an increase in phosphorus is needed to sustain the rapid growth.

A red tide may involve a hundred or more square miles of sea surface, and a large quantity of phosphorus would be required to significantly increase phosphorus concentration in the top foot of sea surface. For example, to increase the phosphorus concentration from 0.01 mg per liter to 0.02 mg per liter in the top foot of 100 square miles of ocean would require about 1,740 pounds of phosphorus. Land sources of phosphorus are suspect because the red tides usually occur in summer when heavy rains cause runoff into coastal waters.

However, coastal sands containing phosphatic material could also release very large amounts of phosphorus during summer rains and storms. A mile of beach with a million cubic yards of sand containing a pound of phosphatic material per ton of sand contains about 225,000 pounds of phosphorus in 1.5 million tons of sand; that is the amount of phosphorus contained in more than 17 million pounds of a typical lawn fertilizer containing 3% of phosphorus reported as P205 (3% P205=1.32% P). Three of four sand samples from Florida west coast beaches examined contained more than one pound of phosphatic material per ton of sand.

The phosphatic material is poorly soluble in seawater, but yields solutions of about 1 mg of phosphorus per liter of rainwater or groundwater, and several ppm of phosphorus in water made acidic by decaying organic matter. In addition, the relatively soft phosphatic material is subject to abrasion by the hard silica sand by wave action and burrowing animal activity. The very fine abraded material may supply not only phosphorus to red tide organisms, but a supply of soluble iron as well. Coastal sands in offshore deposits and sand in coastal currents may also supply substantial phosphorus from phosphatic materials to seawater, especially when disturbed during violent storms.

Costly efforts to reduce phosphorus runoff from the land have been made in many coastal communities. Efforts to further restrict phosphorus fertilizer use may prove poorly cost effective and damage lawns and reduce crop yields. Net flow of phosphorus into offshore waters might be more economically achieved by removing phosphatic materials from coastal sands. Sand for renourishing beaches would be most economically freed of phosphatic material during needed handling and transportation, but existing beaches could also be processed. Possibly it would prove cost effective to remove phosphatic material from some marine sand deposits even if no immediate use of the sand was available. The recovered phosphatic material might have some value, for example in conventional fertilizer production or as a slow release phosphorus fertilizer. This disclosure demonstrates that the phosphatic materials can be separated from the sand by a froth flotation process.

BRIEF SUMMARY OF THE INVENTION

Froth Flotation

In the froth flotation process of this Disclosure, sand suspended in water is sparged with air (or other useful gas), i.e. introducing compressed air which causes bubbles of air to move upwardly through the mixture. Components that are attracted to the surface of the air bubbles are floated to the surface of the liquid in the bubble froth, and can be skimmed off. Chemicals called conditioners that are selectively absorbed by components to be floated are usually required.

Froth flotation has been widely used in the phosphate mining industry to separate phosphate minerals from sand. It has been found that neither the highly rounded and smooth nature of phosphatic materials in beach sands, nor the long exposure of phosphatic materials to seawater interferes with their flotation from sand.

Conditioners are available for causing the sand to float, as well as for causing the phosphatic materials to float. However, flotation of the phosphatic material should prove more practical. The phosphatic material will generally be the minor component, so that less conditioner will be required. In addition, the sand is to be returned to the marine environment, and minimal adsorbed conditioner on its surface will likely be preferred. However, this disclosure is not to be restricted to any particular flotation process or flotation conditioner for separation of phosphatic material from coastal sands.

Many compounds and mixtures have been shown to be useful in floating phosphate minerals, and these are usually carboxylic acids. Generally carboxylic acids obtained by hydrolysis of fats and oils from animals and plants are most cost effective. A technical grade of oleic acid containing some polyunsaturated and saturated carboxylic acids is frequently used, and was selected for use in the examples of this Disclosure. The oleic acid is biodegradable and traces are non-toxic to sea life, so that minor amounts in sand and water returned to the beach would be acceptable. Long practice in the phosphate mining industry has demonstrated that a mixture of oleic acid with a hydrocarbon in a ratio of about 70:30 weight percent is more effective than oleic acid alone. A mixture of 70:30 oleic acid: diesel fuel was used in most of the examples in this Disclosure. Diesel fuel may be environmentally objectionable. White mineral oil has been shown to be an effective substitute for diesel fuel ("Florida Institute of Phosphate Research, The First Twenty Five Years, Recently Completed Projects," FIPR Report (2003-2004) Bartow, Fla.) Cameron, et al., in U.S. Pat. No. 6,994,786 teaches that the highly biodegradable methyl esters in products like biodiesel fuel are effective substitutes for diesel fuel in flotation conditioners for phosphate ores.

Many coastal regions have shortages of freshwater supplies. H. O. Ozbelge, et al., "Use of Sea water in the Flotation of Carbonate Rich Sedimentary Phosphate Rock," Fertilizer Research, 34, P217-222 (1993) has demonstrated that flotation of phosphate ores is possible in seawater. For this invention it has been demonstrated that flotation separation of phosphatic material from coastal sand in seawater is also effective.

Sand for beach renourishment taken from offshore sand sites is usually transported to a barge, or directly to the beach, through a pipeline as about a 10% slurry in water. The almost limitless supplies of seawater could simplify a process for flotation of phosphatic material from coastal sand. Mixing of the conditioner with the sand could be accomplished by adding the conditioner to the pipeline, and the sand could then be air sparged for removal of phosphatic material where the sand was currently being deposited on the beach or barge.

Under the conditions of flotation used in the Examples, a significant amount of sand was included in the phosphatic material floated fraction. The amount of sand under actual commercial operations could be reduced through changes in process conditions, as understood by those skilled in the art. Flotation becomes less effective as particles of phosphatic material exceed about 2 mm. If significant amounts of large phosphatic materials are present in sand, screening or other separation process may be needed to supplement flotation.

Small shell, coral and limestone fragments are floated out with the phosphatic material when some flotation conditioners, including the carboxylic acid types, are used. Conditioning chemicals have been identified (Z. Gu et al., U.S. Pat. No. 4,804,462 (1989), (J. D. Miller et al., U.S. Pat. No. 6,341,696 (2002) that will selectively float phosphatic material without including shell, coral or limestone fragments, if it is desired to retain such fragments in the sand.

This invention is directed to a process for separating phosphatic materials from coastal beach sand and sand deposits used for beach renourishment. The steps include (a) suspending a mixture of beach sand and phosphatic material in water, (b) introducing compressed gas, preferably air, into the mixture by sparging to produce a bubble froth on the surface of the water, and (c) skimming or separating the bubble froth from the surface of the water to effect separation of the phosphatic material in the froth from the beach sand left in the water. The bubbles of the bubble froth attract and carry the phosphatic material on the surface of the bubbles during upward movement through the mixture. A conditioner added to the water which enhances the tendency of phosphatic material to cling to the bubbles is preferred.

An object of this disclosure is to separate phosphatic materials from coastal beach sand and sand deposits.

BRIEF DESCRIPTION OF THE SEVERAL VIEWS OF THE DRAWING(S)

FIG. 1 is a schematic view of the test equipment used in the various examples and test data described herebelow.

Exemplary embodiments are illustrated in reference figures of the drawings. It is intended that the embodiments and figures disclosed herein are to be considered to illustrative rather than limiting.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

DETAILED DESCRIPTION

Samples were taken from single locations about 100 feet from the waterline at five beaches along a 150-mile length of west Florida coastline. All samples contained significant amounts of phosphatic material. The quartz sand particles in the samples were of similar size, 0.1 mm to 0.2 mm. The samples are not necessarily representative of the entire beach.

Fort Myers Beach

The sample from this beach contained 1600 ppm of phosphorus. The light gray color of this sample was partially due to the 5% of shell fragments it contained. A collection of black particles of about 0.1 mm diameter were hand separated from the sample; this collection contained 10.6% phosphorus.

Casperson Beach

This beach sample contained 10,000 ppm (1.00%) of phosphorus. This very dark sample contained about 0.5% of material that was retained on a 4 mm screen, about half the retained particles larger than 4 mm were shell and half were black phosphatic material.

Venice Municipal Beach

This very dark sample contained 380 ppm of phosphorus. It was found to consist of 90% shell fragment and only 8.8% of quartz sand.

Siesta Key Beach

This sample from a very white beach consisted of about 99% quartz sand with 153 ppm phosphorus and less than 1% of shell fragments.

St. Petersburg Municipal Beach

This sample from a very light tan beach contained about 10% shell fragments and 44 ppm of phosphorus. A collection of hand picked black particles from the sand contained 8.2% of phosphorus. Not all the particles in the collection dissolved in acid and were possibly charcoal from cigarettes.

The Casperson Beach and Siesta Key Beach samples were selected for evaluation in the flotation Examples.

Flotation Apparatus

This laboratory apparatus shown generally at numeral 10 in FIG. 1 includes four components. The flotation vessel 12 is a flat bottom cylindrical glass vessel of inside height 14.5 cm and inside diameter 3.8 cm. The stirrer motor 18 is connected to output shaft 22 which rotates in the direction of arrow A. A stirrer blade 20 is 1 cm high, 2.6 cm wide rectangular paddle with a slight pitch to lift liquid from the bottom of the flotation vessel 12. The froth collector 14 is a 400 ml bowl placed under the flotation vessel 12. The air disperser 26 is a 1.3 cm diameter×2.0 cm long porous ceramic bubbler, connected by tubing 28 to a 4-liter per minute air pump 24.

Operation

The bottom of the stirrer blade 20 was positioned 1 cm from the bottom of the flotation vessel 12. After adding 50 g of sand 30 and 50 g of test water to the flotation vessel 12, stirring was begun, and the speed was adjusted until no clear water layer remained. The flotation conditioner was added in one portion and stirring was continued for three minutes. The flotation vessel was then filled with the test water, and stirring was increased until a 4 cm clear water layer 32 remained at the top of the flotation vessel 12.

Air sparging was begun with the air dispenser 26, being positioned 2 cm above the stirrer blade 20 dispensing air bubbles 40. Makeup water was continuously added as required to make up for water flowing over the top of the flotation vessel with the air froth 36 as shown by the arrows. It is not desirable for the bubbles 40 to rise too quickly; some time is needed for collision with the phosphatic particles. The stirring slows the bubble rise. When the flotation period was completed, the beneficiated sand in the flotation vessel 12, and floated materials at 16 were collected separately, washed with distilled water, dried and weighed. A small layer of liquid 38 with particles collected at the bottom of the froth collector 14 is also collected.

FLOTATION EXAMPLES PERFORMED WITH SIESTA KEY BEACH SAMPLE

Example 1

This example illustrates how the efficiency of flotation in rainwater varies with the amount of oleic acid-diesel oil conditioner used. About 5 mg of conditioner per 50 g of beach sample, equivalent to about 5 ounces per 3000 lb of sand in a cubic yard of sand, appears to be the optimum dosage. At the 5 ppm dosage, 90% of the sand was recovered with a 90% reduction in phosphorus concentration. Even with no conditioner added, some slight reduction in phosphorus concentration by flotation occurred, suggesting that the surfaces of phosphatic materials are naturally attracted to air bubbles, or that some natural conditioner present in seawater had been absorbed on the phosphatic material. See Table 1 and Table 2 below for a summary of the results.

TABLE 1

Retained Fraction of Sand after Flotation for Varying Amounts of Oleic Acid/Diesel Fuel Conditioner

| Conditioner (mg) | % Weight Retained | PPM Phosphorous | % of Total Phosphorous in Fraction | % Sand in Fraction |
|---|---|---|---|---|
| 100 | 83.4 | 22.0 | 17.2 | 98.9 |
| 25 | 86.2 | 23.8 | 16.0 | 99.3 |
| 5 | 83.4 | 16.3 | 11.1 | 99.6 |
| 2 | 88.4 | 102 | 60.4 | 88.0 |
| 0 | 91.6 | 142 | 86.0 | 93.4 |

TABLE 2

Reject (Floated) Fraction after Flotation for Varying Amounts of Oleic Acid/Diesel Fuel Conditioner

| Conditioner (mg) | % Weight Rejected | PPM Phosphorous | % of Total Phosphorous in Fraction | % Sand in Fraction |
|---|---|---|---|---|
| 100 | 16.6 | 836 | 82.5 | 94.3 |
| 25 | 13.8 | 777 | 84.0 | 94.4 |
| 5 | 16.6 | 654 | 88.9 | 98.7 |
| 2 | 11.6 | 510 | 39.6 | 93.5 |
| 0 | 8.4 | 234 | 13.1 | 94.3 |

Example 2

This example illustrates that tap water from the city of Venice, Fla. municipal water supply is about equivalent to rainwater as a medium for flotation of the Siesta Key Beach sample. See Table 3 below for a summary of the results.

TABLE 3

Results of Flotation of Siesta Key Beach Sand Using 70 ppm Hardness Municipal Water and 25 mg 70:30 Oleic Acid/Diesel Fuel Conditioner

| | % Weight in. | PPM Phosphorous | % of Total Phosphorous in Fraction | % Sand in Fraction |
|---|---|---|---|---|
| Retained Fraction | 78.4 | 22.8 | 3.3 | 99.3 |
| Rejected (Floated) Fraction | 21.6 | 506 | 96.7 | 94.1 |

Example 3

This example illustrates that the more environmentally friendly white mineral oil can be substituted for diesel oil in conditioner used for flotation of the Siesta Key Beach sample. See Table 4 below for a summary of the results.

TABLE 4

Results of Flotation of Siesta Key Beach Sand Using 70 ppm Hardness Municipal Water and 25 mg 70:30 Oleic Acid/70 SUS White Mineral Oil Conditioner

| | % Weight in | PPM Phosphorous | % of Total Phosphorous in Fraction | % Sand in Fraction |
|---|---|---|---|---|
| Retained Fraction | 80.6 | 25.1 | 13.2 | 98.8 |
| Rejected (Floated) Fraction | 19.4 | 684 | 86.8 | 95.2 |

Example 4

This example shows that seawater can be substituted for freshwater for flotation of the Siesta Key Beach sample, but that more conditioner may be required. See Table 5 and Table 6 below for a summary of the results.

TABLE 5

Retained Fraction of Sand After Flotation for Varying Amounts of Oleic Acid/Diesel Fuel Conditioner Using Seawater

| Conditioner (mg) | % Weight Retained | PPM Phosphorous | % of Total Phosphorous in Fraction | % Sand in Fraction |
|---|---|---|---|---|
| 50 | 73.5 | 32 | 20.0 | 97.5 |
| 25 | 69.9 | 28 | 15.6 | 98.1 |
| 11 | 64.4 | 93 | 37.5 | 98.1 |
| 3 | 86.3 | 109 | 80.0 | 99.2 |

TABLE 6

Reject Fraction after Flotation for Varying Amounts of Oleic Acid/Diesel Fuel Conditioner Using Seawater

| Conditioner (mg) | % Weight Rejected | PPM Phosphorous | % of Total Phosphorous in Fraction | % Sand in Fraction |
|---|---|---|---|---|
| 50 | 26.5 | 345 | 80.0 | 97.2 |
| 25 | 31.1 | 340 | 84.4 | 97.8 |
| 11 | 35.6 | 280 | 62.5 | 98.2 |
| 3 | 13.7 | 172 | 20.0 | 93.5 |

FLOTATION EXAMPLES PERFORMED WITH CASPERSON BEACH SAMPLE

Example 5

Flotation of Casperson Beach Sample in Rain Water

Over 80% of the quartz sand in the sample was recovered at 99.2% purity: flotation removed 97.6% of the phosphorus and almost all of the shell fragments. The recovered sand was a light tan color. The tan color was only partly removed by bleaching agents, and possibly the colored material may be present in microscopic crevices in the sand particles. The sand retained 344 ppm phosphorus. This phosphorus concentration was reduced to 244 ppm after the sand was sieved through a 0.5 mm screen to remove larger phosphatic material particles.

The floated material contained 23,081 ppm (2.3%) of phosphorus, and was a mixture of about 39.8% sand, 44.8% shell fragments and 15.8% phosphatic material. See Table 7 below for a summary of the results.

TABLE 7

Results of Flotation of Casperson Beach Sand Using Rain Water and 75 mg 70:30 Oleic Acid/Diesel Fuel Conditioner

| | % Weight | PPM Phosphorous | % of Total Phosphorous in Fraction | % Sand in Fraction | % Shell in Fraction |
|---|---|---|---|---|---|
| Retained Fraction | 61.8 | 344 | 2.4 | 99.2 | 0.5 |
| Rejected (Floated) Fraction | 38.2 | 23081 | 97.6 | 39.8 | 44.8 |

Example 6

Flotation of Casperson Beach Sample in Seawater

In this flotation 56.2% of the sample was recovered as a light tan product containing 99% silica sand. The flotation had removed almost all shell fragments and 99% of the phosphorus. The sand contained 171 ppm phosphorus. The floated material contained 18,580 ppm (1.85%) of phosphorus; and was a mixture of 47.8% quartz sand, 12.4% phosphatic material and 38.2% of shell fragments See Table 8 below for a summary of the results.

TABLE 8

Results of Flotation of Casperson Beach Sand Using Seawater and 75 mg 70:30 Oleic Acid/Diesel Fuel Conditioner

| | % Weight | PPM Phosphorous | % of Total Phosphorous in Fraction | % Sand in Fraction | % Shell in Fraction |
|---|---|---|---|---|---|
| Retained Fraction | 56.2 | 171 | 1.2 | 99.1 | <1.0 |
| Rejected (Floated) Fraction | 43.8 | 18585 | 98.8 | 47.8 | 39.8 |

CONCLUSION

The examples demonstrate that flotation is a practical process for removal of phosphatic material from sands on beaches or from mined sand intended for beach renourishment. Those skilled in the art will understand how to determine the best flotation conditions for achieving the highest recovery of sand at a specified phosphatic material concentration.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. An in situ process conducted at a beach area for removing unwanted phosphatic materials from coastal beach sand comprising the steps of:

suspending beach sand containing a very small percentage of unwanted brownish or dark colored phosphatic material in water;

activating a water stirrer positioned in close proximity below an air dispenser;

sparging compressed air uniformly into the mixture through the air dispenser to produce a bubble froth on the surface of the water, bubbles of the bubble froth attracting and carrying the unwanted phosphatic material on the surface of the bubbles upwardly through the mixture;

skimming the bubble froth from the surface of the water to effect separation of the unwanted phosphatic material in the froth and the brownish or dark color from the beach sand left in the water.

2. The process of claim 1, further comprising the step of:

introducing a flotation conditioner into the suspension, the conditioner enhancing the tendency of the phosphatic material to float.

3. The process of claim 2, wherein:

the conditioner is carboxylic acid.

4. The process of claim 2, wherein:

the conditioner is oleic acid.

5. The process of claim 2, wherein:

the conditioner is oleic acid and a hydrocarbon.

6. The process of claim 5, wherein:

the hydrocarbon is diesel fuel.

7. The process of claim 2, wherein:

the conditioner is oleic acid and white mineral oil.

8. The process of claim 1, wherein:

the water is sea water.

9. The process of claim 1, wherein:

the water is fresh water.

10. The process of claim 1, wherein:

the phosphatic material is no greater than about 2 mm in width.

11. The process of claim 1, further comprising the step of:

screening the phosphatic material to no greater than about 2 mm prior to suspending the mixture in water.

12. The process of claim 1 wherein:

the percentage of unwanted phosphatic material to be removed from the beach sand is in the range of about 0.01% to 1%.

13. The process of claim 12, further comprising the step of:

introducing a flotation conditioner into the suspension, the conditioner enhancing the tendency of the phosphatic material to float.

14. The process of claim 13, wherein:

the conditioner is carboxylic acid.

15. The process of claim 13, wherein:

the conditioner is oleic acid.

16. The process of claim 13, wherein:

the conditioner is oleic acid and a hydrocarbon.

17. The process of claim 16, wherein:

the hydrocarbon is diesel fuel.

18. The process of claim 13, wherein:

the conditioner is oleic acid and white mineral oil.

19. A process for beach area in situ removal of unwanted phosphatic materials from sand deposits taken from offshore sand sites for beach renourishment comprising the steps of:

drawing a mixture of sand, unwanted brownish or dark colored phosphatic material, and water into a submerged intake of a pipeline extending between the offshore sand sites and the beach area;

adding a flotation conditioner into the suspension within the pipeline to enhance the tendency of the phosphatic material to float in sea water;

discharging the mixture from the pipeline into a floatation vessel at the beach area;

sparging air uniformly into the mixture through an air dispenser within the floatation vessel to produce a bubble froth, bubbles of the bubble froth attracting and separating the phosphatic material and at least a portion of the brownish or dark color from the sand within the water;

skimming the bubble froth to effect separation of the unwanted phosphatic material in the froth from the sand left in the water.

20. An in situ beach area process for removing unwanted phosphatic material from coastal beach sand comprising the steps of:

suspending within a floatation vessel a mixture of beach sand mixed with very small amounts of unwanted brownish or dark colored phosphatic material in a water mixture which also includes a conditioner capable of causing the phosphatic material to float, the beach sand having a range of from 0.01% up to about 1% phosphatic material;

sparging the mixture to produce a bubble froth on the surface of the water, bubbles of the bubble froth attracting and carrying the unwanted phosphatic material and at least a portion of the brownish or dark color on the surface of the bubbles upwardly through the mixture while agitating or stirring the mixture to maintain a substantially uniform distribution of beach sand, unwanted phosphatic material, and air bubbles within the water;

skimming the bubble froth from the surface of the water to effect separation of the unwanted phosphatic material in the froth and brownish or dark color from the beach sand left in the water.

* * * * *